US006746341B1

(12) United States Patent
Hamric, Jr. et al.

(10) Patent No.: US 6,746,341 B1
(45) Date of Patent: Jun. 8, 2004

(54) GOLF CLUB SYSTEM

(76) Inventors: Richard Hamric, Jr., 11172 Greenwood Pl., Beaumont, TX (US) 77705; Scott Hamric, 11172 Greenwood Pl., Beaumont, TX (US) 77705

( * ) Notice: Subject to any disclaimer, the term of this patent is extended or adjusted under 35 U.S.C. 154(b) by 0 days.

(21) Appl. No.: 10/320,562

(22) Filed: Dec. 13, 2002

(51) Int. Cl.[7] ..... A63B 53/02
(52) U.S. Cl. ..... 473/288; 473/306; 473/307
(58) Field of Search ..... 473/288, 298, 473/299, 306, 307; 403/296, 366

(56) References Cited

U.S. PATENT DOCUMENTS 1,253,700 A 1/1918 McLaughlin
1,543,636 A * 6/1925 Williamson ..... 473/306
3,829,092 A 8/1974 Arkin
3,848,737 A 11/1974 Kenon
4,253,666 A 3/1981 Murphy

* cited by examiner

*Primary Examiner*—Stephen Blau

(57) ABSTRACT

A golf club system for reducing the amount of clubs to be carried by a golfer. The golf club system includes a shaft member being designed for being held in the hands of the user. Each of a plurality of head assemblies is selectively coupled to the shaft member. Each of the head assemblies comprises a shank portion and a head portion. The shank portion of each of the head assemblies is selectively coupled to the shaft member whereby each of the head assemblies is designed for striking a golf ball when the shaft member is swung by the user. Each of the head assemblies is designed for causing the golf ball to move at an angle when the associated one of the head assemblies strikes the golf ball.

5 Claims, 5 Drawing Sheets

GOLF CLUB SYSTEM

BACKGROUND OF THE INVENTION

1. Field of the Invention

The present invention relates to universal golf clubs and more particularly pertains to a new golf club system for reducing the amount of clubs to be carried by a golfer.

2. Description of the Prior Art

The use of universal golf clubs is known in the prior art. U.S. Pat. No. 1,253,700 describes a device for providing the user with a single club that is adaptable for different situations. Another type of universal golf club is U.S. Pat. No. 4,253,666 having a collapsible shaft and interchangeable heads for allowing a user to select the desired heads to be used. U.S. Pat. No. 3,848,737 has a set comprising a plurality of golf club heads in a carrying case that are each selectively couplable to a handle for allowing the user to select the desired head to hit the golf ball. U.S. Pat. No. 3,829,092 has a plurality of golf cub heads selectively coupled to a telescoping shaft to accommodate the particular situation the golfer wishes to overcome.

SUMMARY OF THE INVENTION

An object of the present invention is to provide a new golf club system that provides a plurality of head assemblies to allow the user to adapt to the particular situation the golf ball came to rest in.

Even still another object of the present invention is to provide a new golf club system that provides both threaded connection and a locking assembly to ensure that each of the head assemblies is securely attached to the shaft member and do not wobble when the user is swinging the shaft member.

To this end, the present invention generally comprises a shaft member being designed for being held in the hands of the user. Each of a plurality of head assemblies is selectively coupled to the shaft member. Each of the head assemblies comprises a shank portion and a head portion. The shank portion of each of the head assemblies is selectively coupled to the shaft member whereby each of the head assemblies is designed for striking a golf ball when the shaft member is swung by the user. Each of the head assemblies is designed for causing the golf ball to move at an angle when the associated one of the head assemblies strikes the golf ball.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
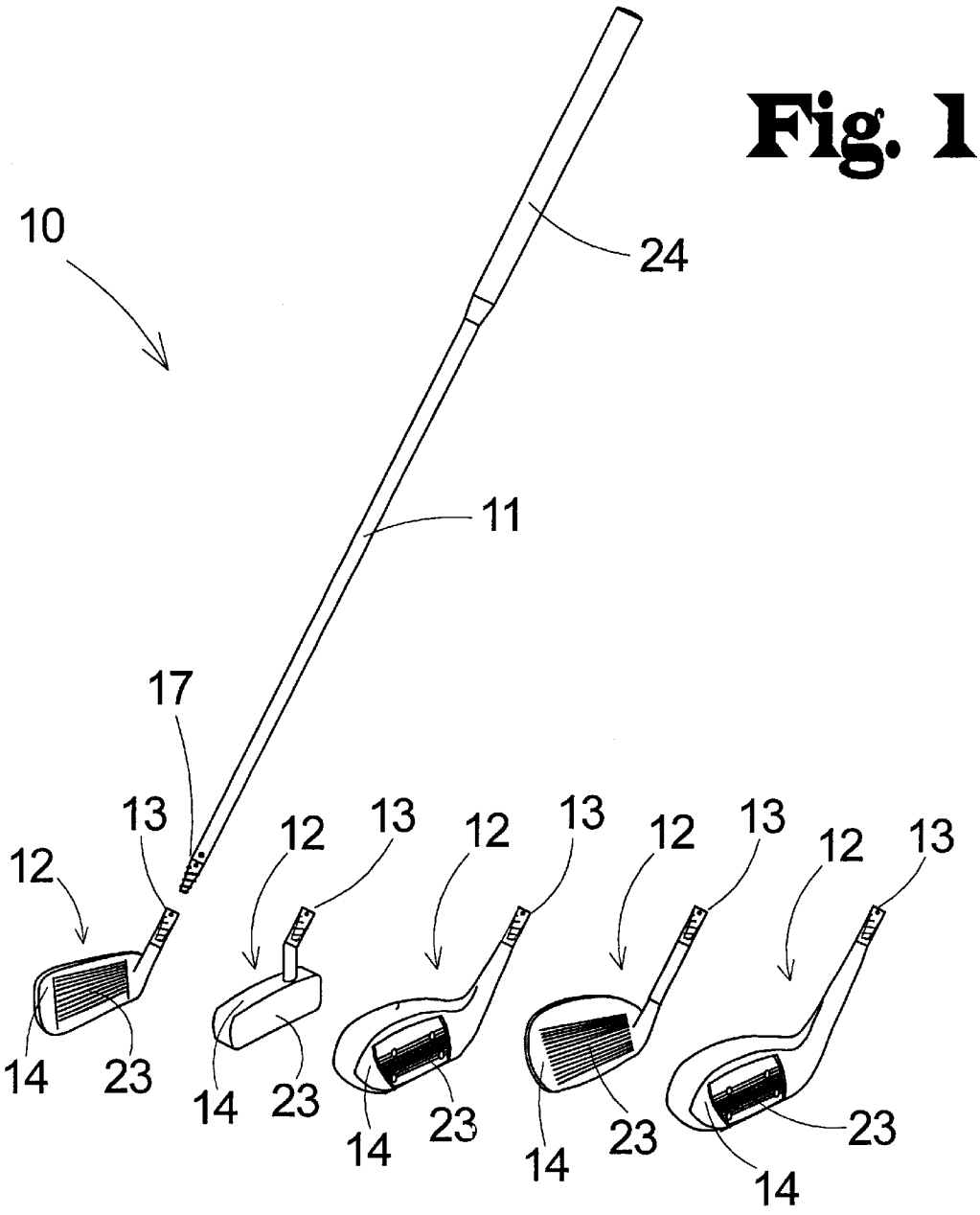
FIG. 1 is a perspective view of a new golf club system according to the present invention.
Figure 2:
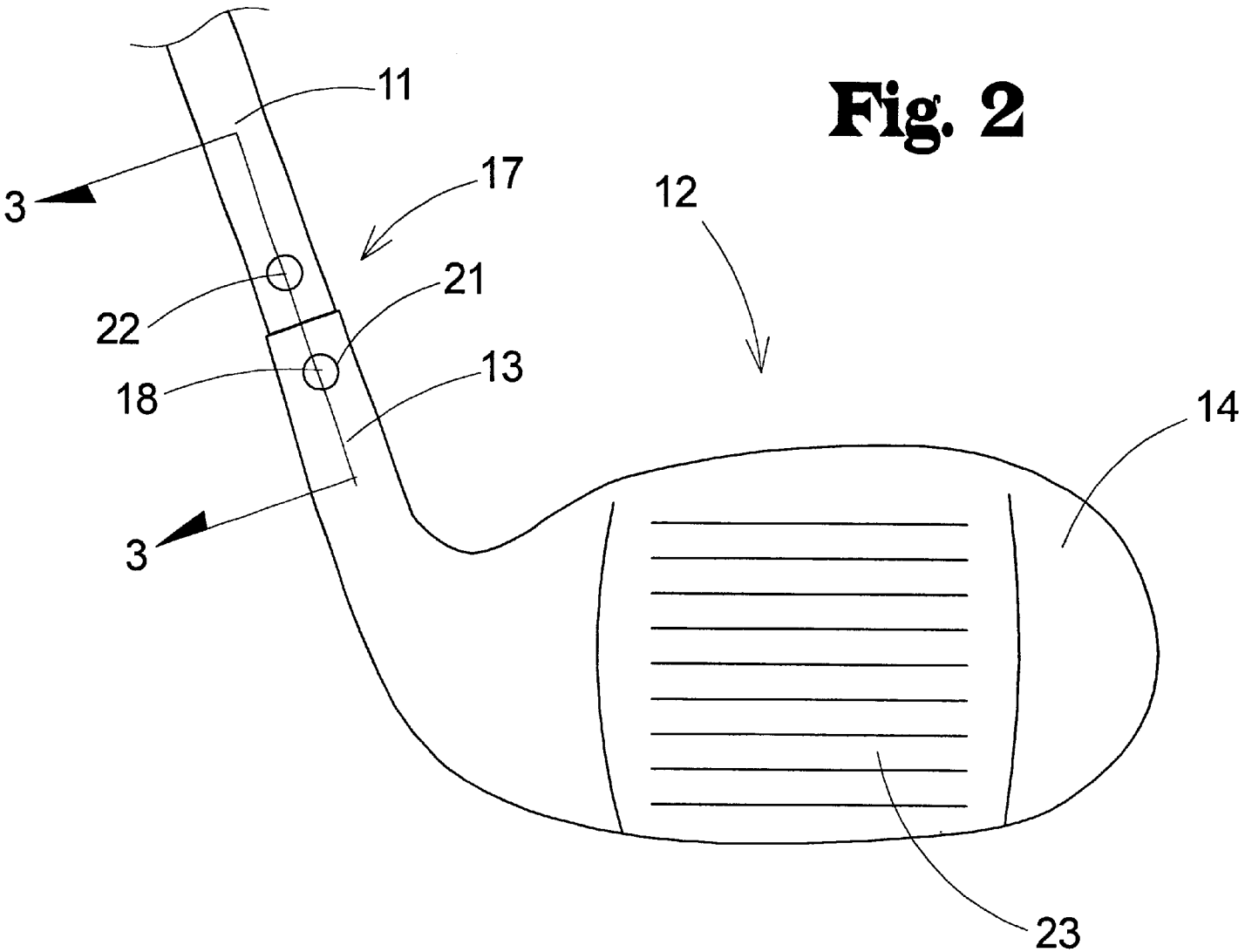
FIG. 2 is a front view of the shaft member coupled to one of the head assemblies of the present invention.
Figure 3:
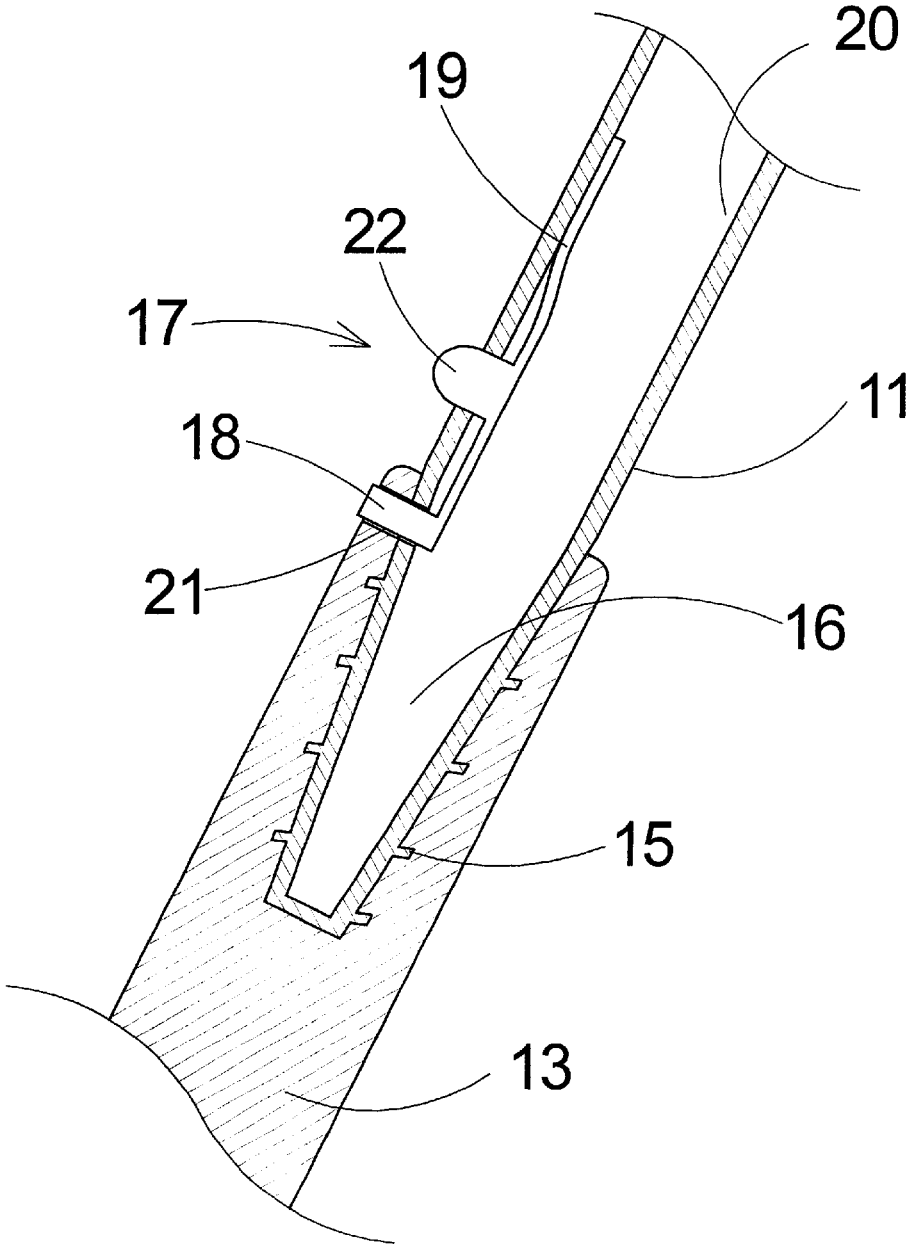
FIG. 3 is a cross-sectional view of the present invention taken along line 3—3 of FIG. 2.

With reference now to the drawings, and in particular to FIGS. 1 through 5 thereof, a new golf club system embodying the principles and concepts of the present invention and generally designated by the reference numeral 10 will be described.

As best illustrated in FIGS. 1 through 5, the golf club system 10 generally comprises a shaft member 11 being designed for being held in the hands of the user.

Each of a plurality of head assemblies 12 is selectively coupled to the shaft member 11. Each of the head assemblies 12 comprises a shank portion 13 and a head portion 14. The shank portion 13 of each of the head assemblies 12 is selectively coupled to the shaft member 11 whereby each of the head assemblies 12 is designed for striking a golf ball when the shaft member 11 is swung by the user. Each of the head assemblies 12 is designed for causing the golf ball to move at an angle when the associated one of the head assemblies 12 strikes the golf ball. The shank portion 13 of each of the head assemblies 12 has a unique length to allow for proper distancing from the user and proper angle of the associated one of the assemblies when the shaft member 11 is being swung.

The shank portion 13 of each of the head assemblies 12 comprises a bore 15. The bore 15 extends into the shank portion 13 of the associated one of the head assemblies 12. The handle portion is selectively slid into the bore 15 of the shank portion 13 of the associated one of the head assemblies 12 for selectively securing the associated one of the head assemblies 12 to the shaft member 11.

The shaft member 11 comprises a distal end 16. The distal end 16 of the shaft member 11 is selectively inserted into the bore 15 of the shank portion 13 of the associated one of the head assemblies 12. The distal end 16 of the shaft member 11 is threaded whereby the distal end 16 of the shaft member 11 threadably engages the bore 15 of the shank portion 13 of the associated one of the head assemblies 12 for securing the associated one of the head assembles to the hand member.

A locking assembly 17 is coupled to the shaft member 11. The locking assembly 17 selectively engages the shank portion 13 of the associated one of the head assemblies 12. The locking assembly 17 is designed for selectively securing the associated one of the head assemblies 12 to the shaft member 11 to inhibit rotation of the associated one of the head assemblies 12 with respect to the shaft member 11 when the shank portion 13 of the associated one of the head assemblies 12 threadably engages the distal end 16 of the shaft member 11.

The locking assembly 17 comprises a locking pin 18 extending through the shaft member 11. A biasing member 19 of the locking assembly 17 is coupled between a lumen 20 of the shaft member 11 and the locking pin 18 of the locking assembly 17. The biasing member 19 biases the locking pin 18 out of the shaft member 11 whereby the locking pin 18 selectively extends through a locking aperture 21 in the shank portion 13 of the associated one of the head assemblies 12 for selectively securing the associated one of the head assemblies 12 to the shaft member 11.

The locking assembly 17 comprises a release pin 22. The release pin 22 extends through the shaft member 11. The release pin 22 is coupled to the biasing member 19. The release pin 22 is designed for being actuated by the user whereby depression of the release pin 22 pushes the biasing member 19 and removes the locking pin 18 from the locking aperture 21 of the shank portion 13 of the associated one of the head assemblies 12. The release pin 22 is positioned away from the distal end 16 of the shaft member 11 whereby the release pin 22 is designed for being actuated by the user to remove the associated one of the head assemblies 12 when the associated one of the head assemblies 12 is coupled to the shaft member 11.

The head portion 14 of each of the head assemblies 12 comprises a striking face 23. The striking face 23 is designed for being positioned at an angle to a support surface whereby the striking face 23 strikes the ball to provide desired movement of the golf ball when the shaft member 11 is swung by the user.

A grip member 24 is coupled to the handle member. The grip member 24 is positioned opposite the associated one of the head assemblies 12 when one of the head assemblies 12 is coupled to the shaft member 11. The grip member 24 is designed for increasing the friction between the hands of the user and the shaft member 11 for inhibiting the shaft member 11 from slipping from the hands of the user when the shaft member 11 is swung by the user.

Figure 4:
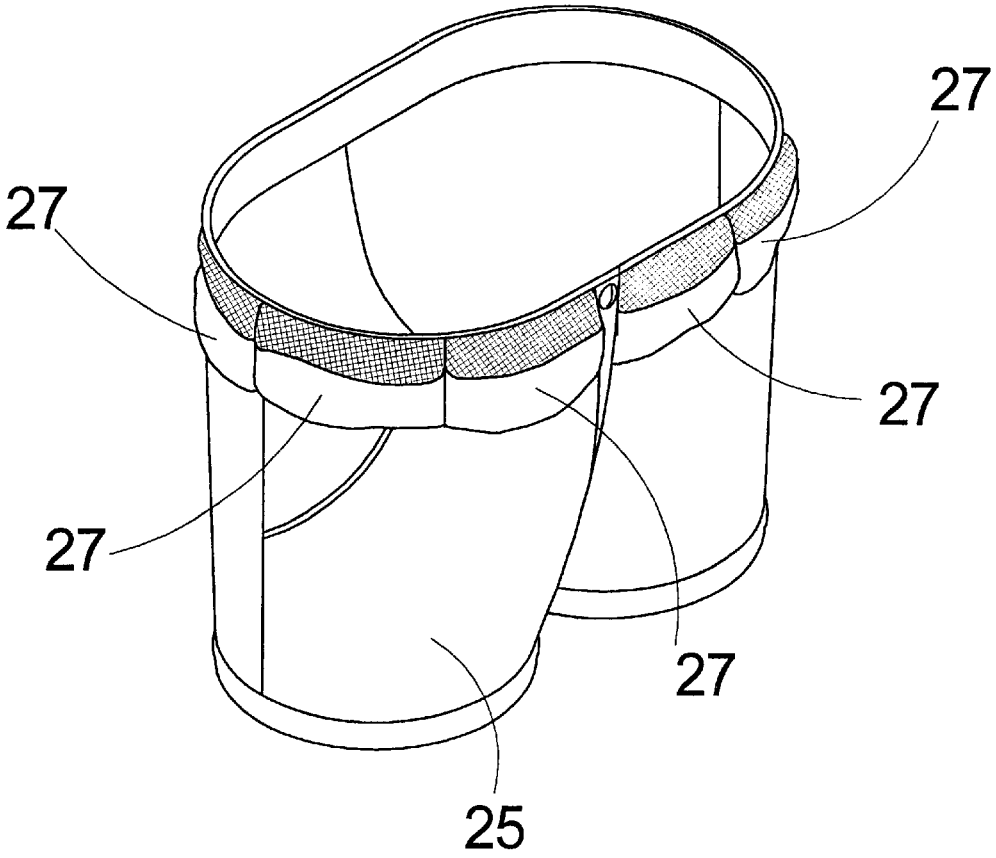
FIG. 4 is a perspective view of the shorts of the present invention.
Figure 5:
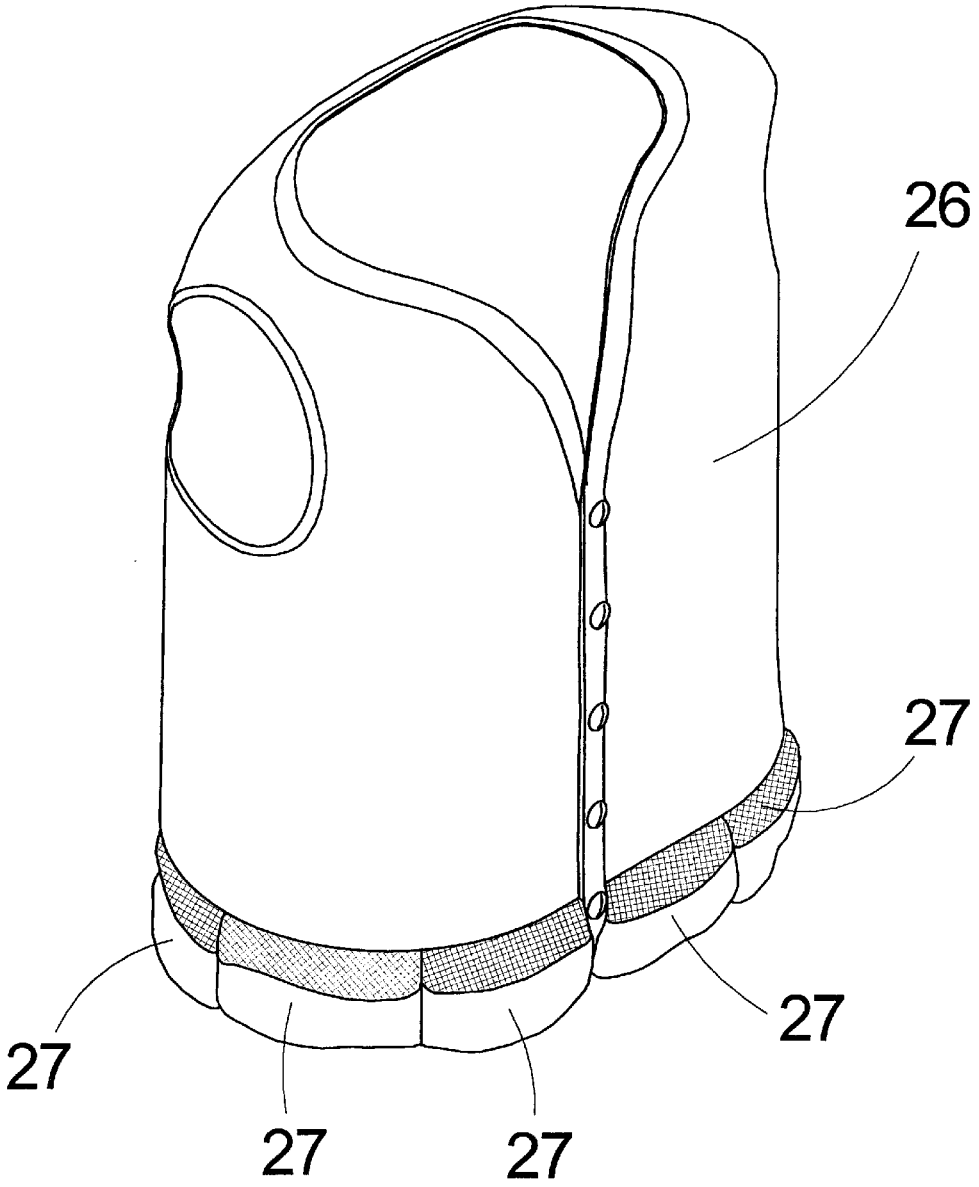
FIG. 5 is a perspective view of the vest of the present invention.

The system may also comprise, as shown in FIGS. 4 and 5, a pair of shorts 25 and a vest 26. A plurality of head pockets 27 are positioned on the shorts 25 and vest 26. Each of the head pockets 27 selectively receives one of the head assemblies 12 permitting the head assemblies 12 to be conveniently carried on the body of the user and allowing ready access the desired head assembly.

In use, the user selects one of the head assemblies 12 and threads the head assembly onto the distal end 16 of the shaft member 11 until the locking pin 18 locks into the locking aperture 21 of the shank portion 13. The user then aligns the strike face with the golf ball and swings the shaft member 11 to impact the golf ball with the striking face 23 and forcing the golf ball in the desired direction. The user can then depress the release pin 22 to slide the locking pin 18 out of the locking aperture 21 and thereby allow the associated one of the head assemblies 12 to be rotated off of the distal end 16 of the shaft member 11 to be replaced with a more desirable one of the head assemblies 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A golf club system for permitting a user to play a game of golf, the golf club system comprising:

a shaft member being adapted for being held in the hands of the user;

each of a plurality of head assemblies being selectively coupled to said shaft member, each of said head assemblies comprising a shank portion and a head portion, said shank portion of each of said head assemblies being selectively coupled to said shaft member such that each of said head assemblies is adapted for striking a golf ball when said shaft member is swung by the user, each of said head assemblies being adapted for causing the golf ball to move at an angle when the associated one of said head assemblies strikes the golf ball;

said shank portion of each of said head assemblies comprising a bore, said bore extending into said shank portion of the associated one of said head assemblies, said shaft member being selectively slid into said bore of said shank portion of the associated one of said head assemblies for selectively securing the associated one of said head assemblies to said shaft member;

said shaft member comprising a distal end, said distal end of said shaft member being selectively inserted into said bore of said shank portion of the associated one of said head assemblies, said distal end of said shaft member being threaded such that said distal end of said shaft member threadably engages said bore of said shank portion of the associated one of said head assemblies for securing the associated one of said head assembles to said hand member;

a locking assembly being coupled to said shaft member, said locking assembly selectively engaging said shank portion of the associated one of said head assemblies, said locking assembly being adapted for selectively securing the associated one of said head assemblies to said shaft member to inhibit rotation of the associated one of said head assemblies with respect to said shaft member when said shank portion of the associated one of said head assemblies threadably engages said distal end of said shaft member; and said locking assembly comprising a locking pin extending through said shaft member, a biasing member of said locking assembly being coupled between a lumen of said shaft member and said locking pin of said locking assembly, said biasing member biasing said locking pin out of said shaft member such that said locking pin selectively extends through a locking aperture in said shank portion of the associated one of said head assemblies for selectively securing the associated one of said head assemblies to said shaft member.

2. The golf club system as set forth in claim 1, further comprising:

said locking assembly comprising a release pin, said release pin extending through said shaft member, said release pin being coupled to said biasing member, said release pin being adapted for being actuated by the user such that depression of said release pin pushes said biasing member and removes said locking pin from said locking aperture of said shank portion of the associated one of said head assemblies, said release pin being positioned away from said distal end of said shaft member such that said release pin is adapted for being actuated by the user to remove the associated one of said head assemblies when the associated one of said head assemblies is coupled to said shaft member.

3. The golf club system as set forth in claim 1, further comprising:

said head portion of each of said head assemblies comprising a striking face, said striking face being adapted for being positioned at an angle to a support surface such that said striking face strikes the ball to provide desired movement of the golf ball when said shaft member is swung by the user.

4. The golf club system as set forth in claim 1, further comprising:

a grip member being coupled to said shaft member, said grip member being positioned opposite the associated one of said head assemblies when one of said head assemblies is coupled to said shaft member, said grip member being adapted for increasing the friction between the hands of the user and the shaft member for inhibiting said shaft member from slipping from the hands of the user when said shaft member is swung by the user.

5. A golf club system for permitting a user to play a game of golf, the golf club system comprising:

a shaft member being adapted for being held in the hands of the user;

each of a plurality of head assemblies being selectively coupled to said shaft member, each of said head assemblies comprising a shank portion and a head portion, said shank portion of each of said head assemblies being selectively coupled to said shaft member such that each of said head assemblies is adapted for striking a golf ball when said shaft member is swung by the user, each of said head assemblies being adapted for causing the golf ball to move at an angle when the associated one of said head assemblies strikes the golf ball;

said shank portion of each of said head assemblies comprising a bore, said bore extending into said shank portion of the associated one of said head assemblies, said shaft member being selectively slid into said bore of said shank portion of the associated one of said head assemblies for selectively securing the associated one of said head assemblies to said shaft member;

said shaft member comprising a distal end, said distal end of said shaft member being selectively inserted into said bore of said shank portion of the associated one of said head assemblies, said distal end of said shaft member being threaded such that said distal end of said shaft member threadably engages said bore of said shank portion of the associated one of said head assemblies for securing the associated one of said head assembles to said hand member;

a locking assembly being coupled to said shaft member, said locking assembly selectively engaging said shank portion of the associated one of said head assemblies, said locking assembly being adapted for selectively securing the associated one of said head assemblies to said shaft member to inhibit rotation of the associated one of said head assemblies with respect to said shaft member when said shank portion of the associated one of said head assemblies threadably engages said distal end of said shaft member;

said locking assembly comprising a locking pin extending through said shaft member, a biasing member of said locking assembly being coupled between a lumen of said shaft member and said locking pin of said locking assembly, said biasing member biasing said locking pin out of said shaft member such that said locking pin selectively extends through a locking aperture in said shank portion of the associated one of said head assemblies for selectively securing the associated one of said head assemblies to said shaft member;

said locking assembly comprising a release pin, said release pin extending through said shaft member, said release pin being coupled to said biasing member, said release pin being adapted for being actuated by the user such that depression of said release pin pushes said biasing member and removes said locking pin from said locking aperture of said shank portion of the associated one of said head assemblies, said release pin being positioned away from said distal end of said shaft member such that said release pin is adapted for being actuated by the user to remove the associated one of said head assemblies when the associated one of said head assemblies is coupled to said shaft member;

said head portion of each of said head assemblies comprising a striking face, said striking face being adapted for being positioned at an angle to a support surface such that said striking face strikes the ball to provide desired movement of the golf ball when said shaft member is swung by the user; and a grip member being coupled to said shaft member, said grip member being positioned opposite the associated one of said head assemblies when one of said head assemblies is coupled to said shaft member, said grip member being adapted for increasing the friction between the hands of the user and the shaft member for inhibiting said shaft member from slipping from the hands of the user when said shaft member is swung by the user.

* * * * *